United States Patent [19]

Titmuss

[11] 4,261,261

[45] Apr. 14, 1981

[54] ROLLER PLATEN IMPRINTER FOR VERTICAL MOUNTING

[75] Inventor: Kenneth W. Titmuss, Emsworth, England

[73] Assignee: Data Card Corporation, Minnetonka, Minn.

[21] Appl. No.: 4,860

[22] Filed: Jan. 19, 1979

[30] Foreign Application Priority Data

Jan. 21, 1978 [GB] United Kingdom ..... 2503/78

[51] Int. Cl.[3] ..... B41F 3/04

[52] U.S. Cl. ..... 101/269; 101/45

[58] Field of Search ..... 101/269, 274, 45, 56, 101/407 BP

[56] References Cited

U.S. PATENT DOCUMENTS

| | | | |
|---|---|---|---|
| 2,149,478 | 3/1939 | Triner | 101/269 X |
| 3,420,171 | 1/1969 | Maul et al. | 101/269 |
| 3,572,241 | 3/1971 | Waterman | 101/269 |
| 3,752,074 | 8/1973 | White et al. | 101/269 |
| 3,838,641 | 10/1974 | McInnis | 101/269 |
| 3,893,393 | 7/1975 | See | 101/269 |
| 4,029,010 | 6/1977 | Deisting | 101/407 BP |
| 4,077,323 | 3/1978 | Livzzo | 101/269 X |
| 4,078,491 | 3/1978 | Schveers | 101/269 |

FOREIGN PATENT DOCUMENTS

| | | | |
|---|---|---|---|
| 1046358 | 10/1966 | United Kingdom | 101/269 |
| 1144934 | 3/1969 | United Kingdom | 101/269 |
| 1163772 | 9/1969 | United Kingdom | 101/269 |
| 1276223 | 6/1972 | United Kingdom | 101/269 |
| 1320110 | 6/1973 | United Kingdom | 101/269 |
| 1413772 | 11/1975 | United Kingdom | 101/269 |

*Primary Examiner*—Edward M. Coven
*Attorney, Agent, or Firm*—Staas and Halsey

[57] ABSTRACT

An imprinting machine has a surface for receiving an embossed card and a form to be imprinted and a carriage having a roller which is movable over the surface to effect an imprinting operation. The machine is capable of being mounted with the surface substantially vertical, and has a groove for retaining one edge of the form and for retaining the card to prevent them falling away from the surface when the machine is disposed vertically. The other edge of the form is preferably located by a guide and the bottom edge of the form by a stop on the surface.

10 Claims, 8 Drawing Figures

ROLLER PLATEN IMPRINTER FOR VERTICAL MOUNTING

This invention relates to imprinting machines.

Such machines imprint information from an embossed card, for example a credit card, on to an information receiving sheet or form.

Previously proposed machines have a base on to which the card and form are placed, and a carriage with a roller which passes over the form and card to effect the imprinting operation. The base is placed on a horizontal surface, for example a desk or table top, so that the carriage effects a horizontal movement across the horizontally disposed card and form.

We have designed an imprinting machine which is capable of being used in the vertical mode, i.e. with the plane of the base being vertical.

In accordance with the invention, there is provided an imprinting machine having a surface for receiving an embossed card and a form or sheet to be imprinted, a carriage having a roller which is movable over the surface to effect an imprinting operation, the machine being capable of being mounted with said surface substantially vertical, and retaining means for retaining the form and the card to prevent them falling away from the surface when the machine is disposed vertically.

The machine preferably has a longitudinally extending groove with which one edge of the sheet in use co-operates and an end stop which is engageable by the lower end of the form to thereby positively locate the form.

The carriage is preferably resiliently biased to its upper, starting position for automatic return of the carriage. In said upper position the carriage preferably defines with the surface a slot for insertion of the form. The upper end of the surface is preferably angled to the major plane of the surface to provide a chute to facilitate insertion of the form.

An imprinting machine in accordance with the invention will now be described, by way of example with reference to the accompanying drawings, in which.

Figure 1:
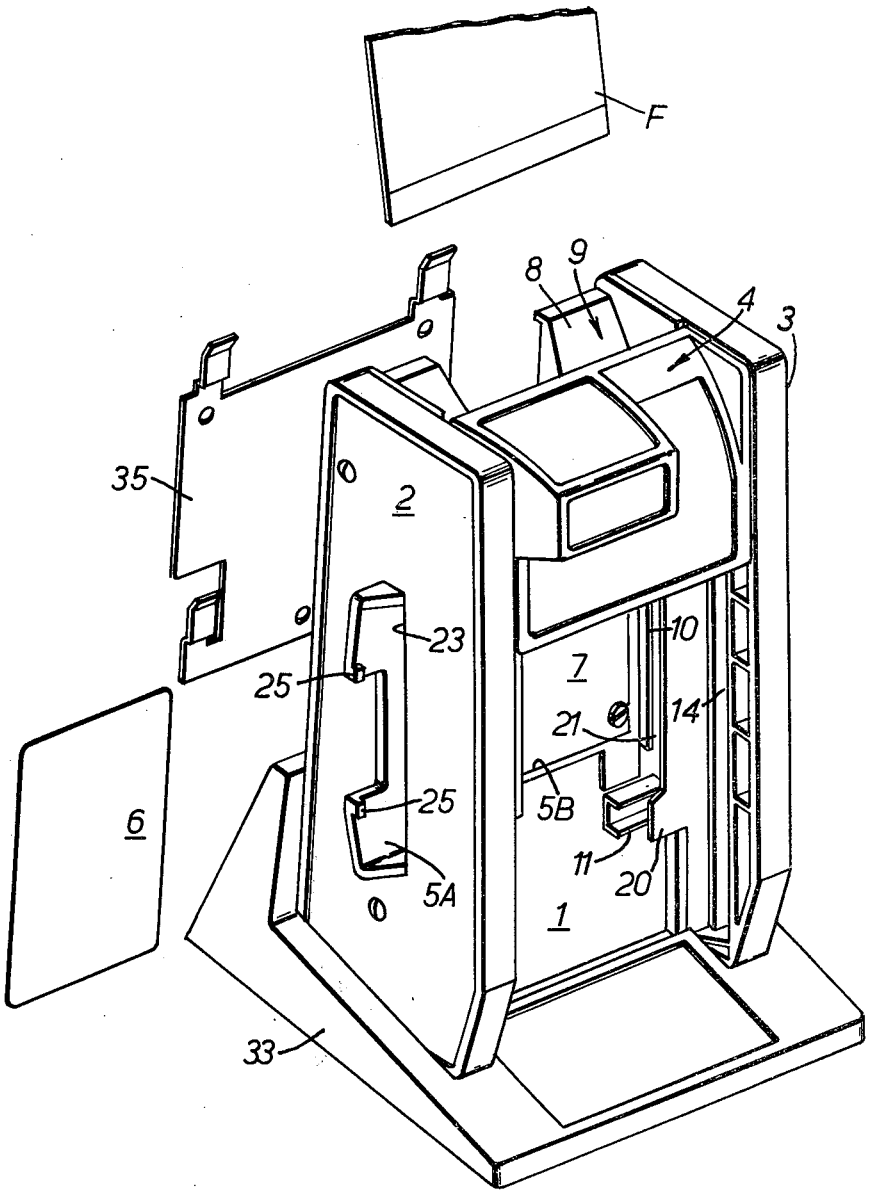
FIG. 1 is a perspective view of the machine.

The machine comprises a base 1, two side frames 2,3 and the carriage 4. The base 1 has a recess 5A for locating an embossed credit card 6 and a recess 5B into which a dealer plate 7 fits, the plate being screwed to the base. Alternatively, the dealer plate may be secured by a clamp (not shown) which fits over the edge of the plate and which is screwed to the base. The use of the clamp permits different sizes of plate to be held in place. The dealer plate is a metal embossed plate which carries static information indicating the location of the machines. A date box may also be secured to the base if required.

At one end the base 1 has a sloping portion 8 which forms with the carriage 4 a chute 9 for insertion of a form F on to which information is to be imprinted. The base 1 also has a guide ramp 10 which deflects the form F over the dealer plate 7 to prevent fouling of the form by the plate.

A channel-shaped stop 11 is secured to the base 1 for location of one end of the form and is so shaped and so secured by retaining pegs which are off set from the longitudinal axis of the stop 11 that if turned through 180° the position of the surface thereon engaged by the form is different to thereby accommodate two different lengths of form.

Figure 5:
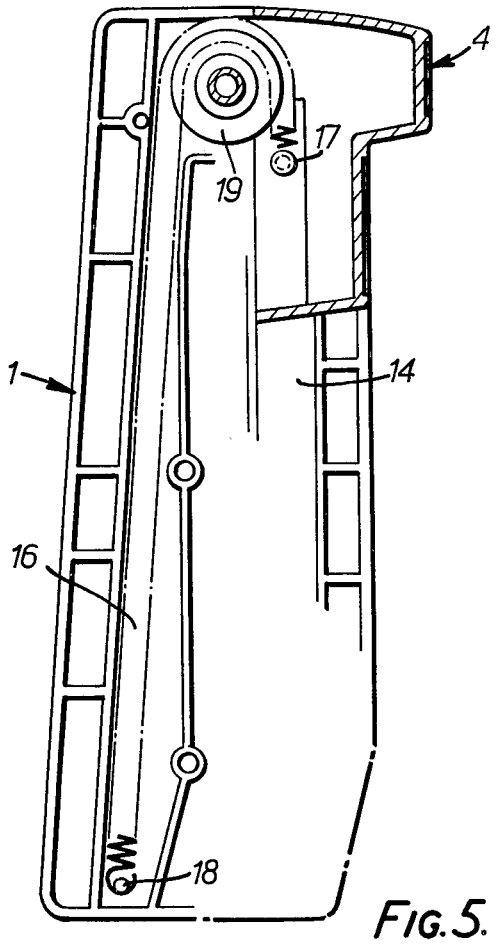
FIG. 5 is a part sectional view illustrating a return spring arrangement.
Figure 6:
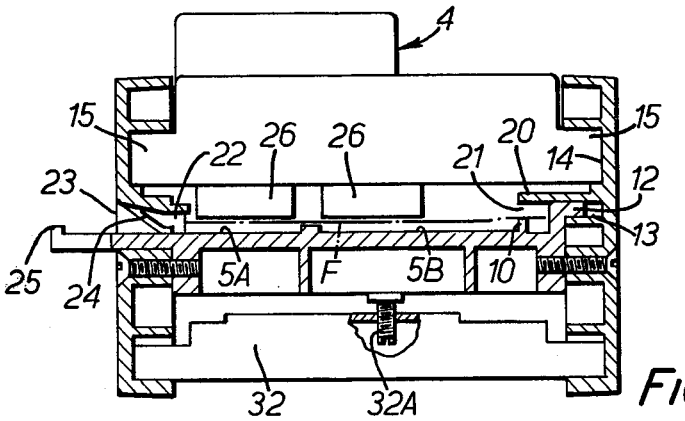
FIG. 6 is a transverse cross-sectional view taken along lines VII—VII of FIG. 2.
Figure 7:
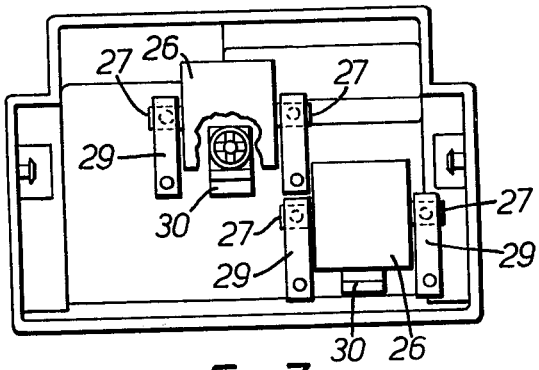
FIG. 7 is a view from beneath of a carriage of the machine.

The side frames 2,3 are similar to each other and are accurately located relative to the base by a plurality of tongues 12 (FIG. 6) which are formed on the base and which engage in complementary recesses 13 in the side frames. Each side frame 2,3 has a channel 14 which receives a projection 15 on the carriage 4 to permit sliding movement of the carriage 4 over the base 1. Located in each side frame 2,3, is a coil tension return spring 16 one end of which is connected to a pin 17 on the carriage 4 (FIG. 5) and the other end of which is attached to a pin 18 integrally moulded with the side frame. Each spring 16 passes around a roller 19 mounted in its side frame.

An elongate projection 20 is provided in the side frame 3 and forms with the base 1 a guide slot 21. The slot 21 guides the form to its desired print position and the projection 20 overlies the right hand side edge of the form and prevents the form from falling out of the machine when the machine is used in the up-right position as will be described below.

The left hand edge of the form contacts a guide 22 which ensures that the form is properly aligned in the machine and that the right hand edge of the form is within the slot 21.

The left hand side frame 2 has an opening 23 for the insertion of the credit card and leaf springs 24, preferably integrally moulded with the side frame 2, for holding the card in the recess 5A in the base. Projections 25 are upstanding from the base and when the trailing edge of the card passes over the projections 25, an audible "click" is heard which indicates that the card is properly located in its recess 5A.

Two rollers 26 are located in the carriage 4, one roller being arranged to print from the credit card and the other from the dealer plate.

Each roller has a pair of shaft portions 27 which are located in angled slots 28 formed in respective support members 29. Leaf springs 30 bias the respective rollers towards the upper ends of the slots, and thus, towards the base 1. Each support member 29 is secured to the carriage 4 by two retainers 31A,31B. One retainer 31A is a grub screw which is screwed into a through hole 37 in the carriage 4 and engages in a blind hole 38 in the support member 29. The grub screw is thus assessible through the hole 37 from outside the carriage 4. The other retainer 31B has a screw portion 39 which is screwed in a through hole 40 in the carriage and a plain unthreaded portion 41 which fits in a through aperture 42 in the support member 29. The plain portion 41 has a head 43 which pushes through a reduced diameter portion 44 of the through aperture 42 so as to be a snap fit in the aperture. The positions of the retainers 31A,31B can be altered by rotating the screws to thereby alter the position of the associated shaft portion 27 and adjust the print pressure. Normally, both retainers 31A and 31B are adjusted together to maintain a desired angle of incidence between the upper portion of the slot 28 with the line of action of the carriage 4.

In use a form F is inserted into the chute 9 and is properly located laterally by the guide 22 and groove 21 and longitudinally by its engagement with the stop 11. The carriage 4 is then pulled from its illustrated inoperative condition along the form. In this operation, the shaft portions 27 are returned to their extreme positions at the ends of the slots 28 in which the rollers 26 are closest to the base 1 and the rollers effect an imprinting operation. The carriage is then released and returns under the action of return springs 16 to its upper inoperative position. On the return stroke, the shaft portions 27 move along the slots 28 away from the base, removing the imprinting pressure and avoiding a second print operation.

Figure 4:
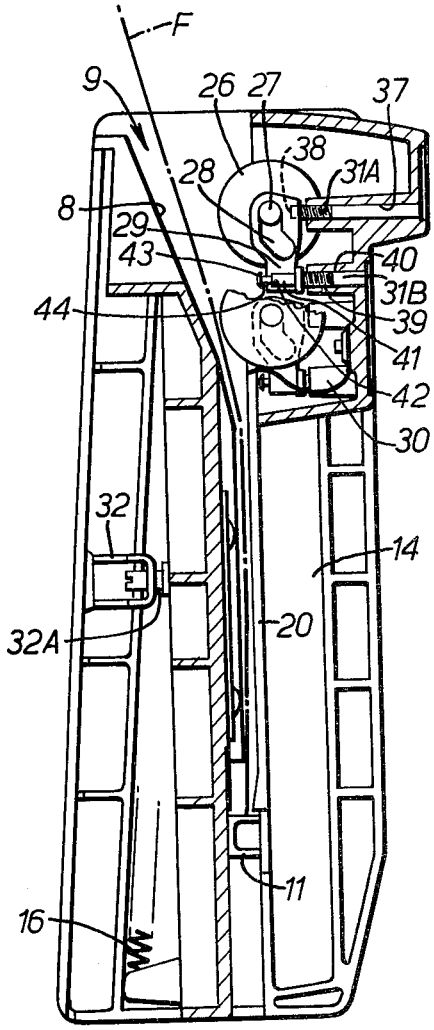
FIG. 4 is a longitudinal cross-sectional view.

In order to strengthen the machine, a steel strengthening member 32 (FIGS. 4 and 6) is secured to the base by a screw 32A and is arranged to transfer from the base 1 to the side frames 2,3 the loads acting perpendicularly to the base.

The above-described machines has only a small number of components most of which can be made of plastics material. The machine is compact and lightweight and can, as illustrated in the drawings, be used upright on its end in a variety of modes, for example on a desk top or mounted on a wall.

Figure 2:
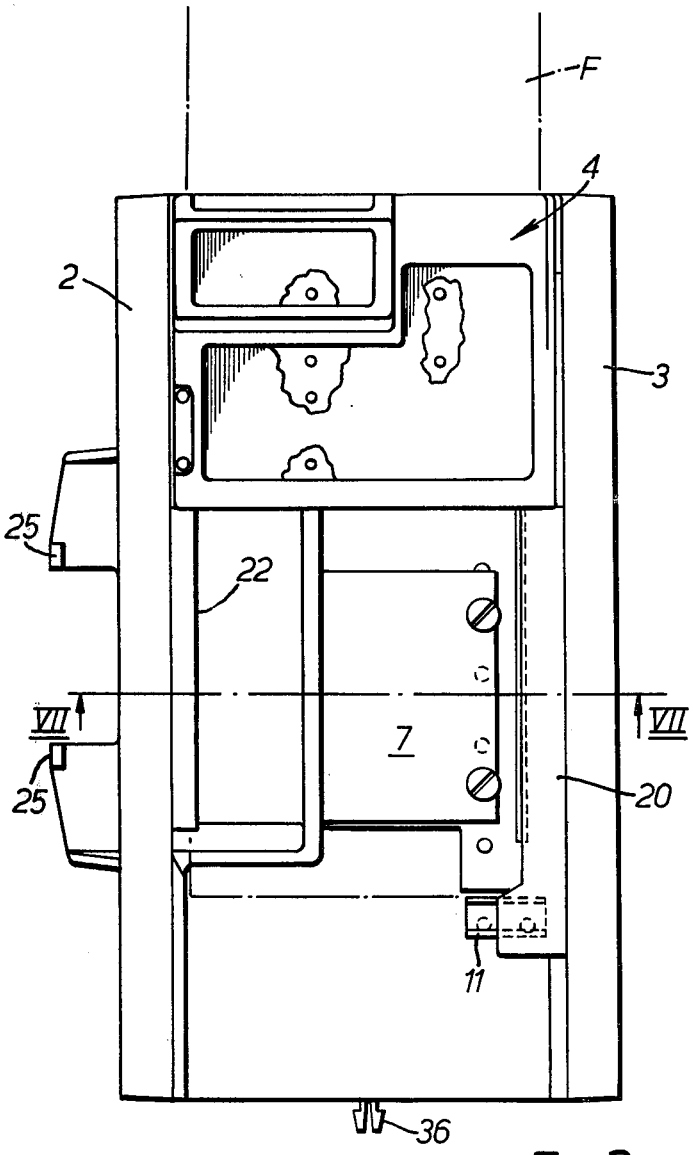
FIG. 2 is a plan view of the machine with a part cut away.
Figure 3:
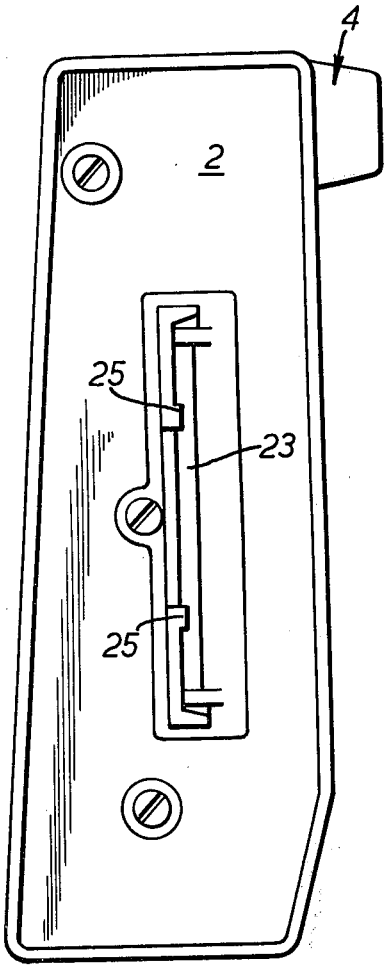
FIG. 3 is a side view.
Figure 8:
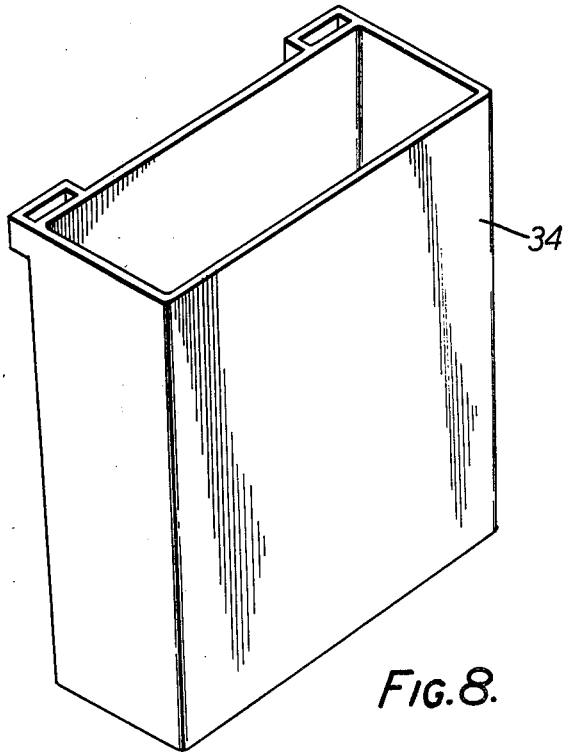
FIG. 8 is a perspective view of a form receptacle for attachment to the machine.

FIG. 1 shows the machine mounted upright on a support or plinth 33. In this case a resilient barb 36 may be provided (FIG. 2) to be a push fit in a recess (not shown) in the plinth 33. A form receptacle 34 (FIG. 8) may be secured to the back of the machine by any suitable means. Because of its upright mounting, the machine occupies less desk space than known machines in which the base is in contact with the desk top. However, the machine will still operate when standing on its base.

As an alternative, the machine may be mounted on a wall, for example by locking the machine on to a wall plate 35 (FIG. 1). The form receptacle 34 may be mounted side-by-side with the machine on a single wall plate of enlarged size (not shown).

In the wall-mounted modes, the machine can be readily removed for overnight storage for security reasons.

It will be appreciated that the springs biasing of the carriage to its upper position ensures that the carriage is returned to its inoperative position ready for the next imprinting operation and is held in that position to permit insertion by the operation of the credit card and form. Furthermore, the form is positively located within the machine and cannot fall out even when the machine is upright.

Since different size credit cards exist in practice, different bases for the respective cards are normally provided since each base will handle only one size card.

I claim:

1. An imprinting machine designed for vertical mounting comprising means defining a substantially vertical surface when so mounted for receiving an embossedcard and a form to be imprinted, a manually operated carriage for substantially up and down movement adjacent said vertical surface which is resiliently biased to an upper, normal starting position, a roller which is supported substantially horizontally by said carriage and which is movable over said surface when said carriage is moved downwardly to effect an imprinting operation, the machine normally when ready for use being mounted with said surface substantially vertical, retaining means for retaining said form and said card to prevent them falling away from said substantially vertical surface when disposed vertically so that proper imprinting will be effected when said carriage is operated manually in a downward movement, said carriage when in said normal ready for use upper position defining with said surface a slot for receiving the form, and the upper end of said surface being angled to the major plane of said surface to provide a chute to facilitate insertion of said form into the slot, said chute opening from an upper substantially horizontal face of the machine.

2. A machine according to claim 1, wherein said retaining means comprises means defining a longitudinally extending groove into which one edge of the form can extend to retain that edge.

3. A machine according to claim 2, including an end stop whichis engageable by a lower end of said form.

4. A machine according to claim 2, including a guide which is engageable by an edge of said form opposite to said one edge in said groove.

5. An imprinting machine according to claim 1, wherein said form when vertically inserted in the machine has two opposed side edges and a lower edge, and wherein said retaining means comprises means defining a longitudinally extending groove into which one said edge of said form extends, and including a guide which engages the other said edge of said form to laterally locate said form, which engagement ensures that said one edge of said form is within said groove, and a stop on said surface which stop is engageable by said lower edge of said form to longitudinally locate said form.

6. An imprinting machine comprising:

a housing structure designed for vertical mounting having a surface which is substantially vertical when the housing is so mounted for receiving an embossed card and a form to be imprinted, side panels supporting a manually operable carriage for up and down traverse movement across said substantially vertical surface;

at least one roller being supported substantially horizontal by said carriage for movement therewith over said surface to effect an imprinting operation when said carriage is moved downwardly, means supporting said at least one roller in said carriage to permit movement of said roller away from said card and form during the upward return movement of said carriage after an imprinting operation so no further imprinting will occur;

retaining means for said card and form to prevent them from falling away from said vertical surface so that proper imprinting will occur when said carriage is operated manually in the downward imprinting movement;

each of said side panels containing a bias spring for normally biasing the manually operable carriage to an upper starting position in the housing and yet permitting a downward movement of the carriage by manual operation to effect the desired imprinting operation;

said carriage when in said normally biased upward position defining with said surface a vertical slot for receiving the form to be imprinted;

and the upper end of said surface being angled to the major vertical plane of said surface to provide a chute to facilitate insertion of said form into the slot, said chute opening from an upper substantially horizontal face of the machine.

7. A machine according to claim 6, wherein said retaining means includes a longitudinally extending groove into which a side edge of the form extends, further includes a guide for engagement with the opposite side edge of said form to readily locate and position said form with said first edge within said groove, and a stop on said surface near the lower end of the machine for engagement with the lower end of the form to longitudinally locate the form.

8. A machine according to claim 7, wherein said stop is constructed so as to permit reversing of same for the purpose of positioning forms of different lengths.

9. An imprinting machine according to claim 6, wherein two rollers are provided on said carriage, each roller being supported by a pair of angular slots to allow said rollers to move away from said imprinting position during the return movement of said carriage under the bias springs, and adjustment means to permit adjustment of the movement of said rollers to assure a proper imprinting operation.

10. A machine according to claim 6, wherein a side slot is provided for reception of an embossed card, said side slot being provided with extending projections and card engaging retention springs for retaining an embossed card in proper imprinting position after insertion into the machine.

* * * * *

UNITED STATES PATENT AND TRADEMARK OFFICE

CERTIFICATE OF CORRECTION

PATENT NO. : 4,261,261

DATED : April 14, 1981

INVENTOR(S) : Kenneth W. Titmuss

It is certified that error appears in the above—identified patent and that said Letters Patent is hereby corrected as shown below:

Column 1, line 7, change "on to" to --onto--.

Column 2, line 3, change "on to" to --onto--;
line 9, change "off set" to --offset--;
line 32, change "up-right" to --upright--;
line 52, change "thus," to --thus--;
line 57, change "assessible" to --accessible--;
line 68, a new paragraph should begin with "Normally,".

Column 3, line 24, after "components" insert --,--;
line 51, change "operation" to --operator--;
line 57, after "size" insert --of--;
line 62, change "bossedcard" to --bossed card--.

Column 4, line 20, change "whichis" to --which is--;
line 53, change "saId" to --said--.

Signed and Sealed this

*Fifteenth* Day of *September 1981*

[SEAL]

*Attest:*

GERALD J. MOSSINGHOFF

*Attesting Officer*

*Commissioner of Patents and Trademarks*